US005368656A

United States Patent [19]

Heitmann et al.

[11] Patent Number: 5,368,656

[45] Date of Patent: Nov. 29, 1994

[54] STEEL SPRING AND METHOD FOR PRODUCING SAME

[75] Inventors: William E. Heitmann, Crown Point; Prabhat K. Rastogi, Munster; Thomas G. Oakwood, Valparaiso, all of Ind.

[73] Assignee: Inland Steel Company, Chicago, Ill.

[21] Appl. No.: 136,662

[22] Filed: Oct. 14, 1993

Related U.S. Application Data

[62] Division of Ser. No. 821,974, Jan. 16, 1992, Pat. No. 5,282,906.

[51] Int. Cl.[5] ..... C21D 9/02; C22C 38/24; C22C 38/26

[52] U.S. Cl. ..... 148/333; 148/908; 148/580; 148/654

[58] Field of Search ..... 148/908, 580, 654, 333; 420/104; 267/166, 167, 286

[56] References Cited

U.S. PATENT DOCUMENTS

| | | | |
|---|---|---|---|
| 4,838,962 | 6/1989 | Huchtemann et al. | 148/328 |
| 5,009,843 | 4/1991 | Sugimoto et al. | 148/908 |
| 5,118,469 | 6/1992 | Abe et al. | 148/908 |
| 5,183,634 | 2/1993 | Abe et al. | 420/110 |

FOREIGN PATENT DOCUMENTS

| | | | |
|---|---|---|---|
| 132355 | 9/1978 | Germany . | |
| 0072318 | 6/1977 | Japan . | |
| 0120616 | 7/1982 | Japan . | |
| 257637 | 2/1990 | Japan | 148/580 |

*Primary Examiner*—Deborah Yee
*Attorney, Agent, or Firm*—Marshall, O'Toole, Gerstein, Murray & Borun

[57] ABSTRACT

A hot rolled steel bar is subjected to controlled hot roll finishing and cooling conditions which, together with the composition of the steel and controlled subsequent heat treating and quenching conditions, enable the formation of a steel spring having both relatively high hardness and high toughness.

27 Claims, No Drawings

STEEL SPRING AND METHOD FOR PRODUCING SAME

This is a division of application Ser. No. 07/821,974, filed Jan. 16, 1992, now U.S. Pat. No. 5,282,906.

BACKGROUND OF THE INVENTION

The present invention relates generally to rolled steel bars and more particularly to rolled steel bars for making high strength, high toughness coil and leaf springs, to the methods for producing such springs from the rolled steel bars and to the resulting springs.

A leaf spring typically comprises a plurality of leaf spring leafs assembled together to form a multi-layered spring, but it can comprise only a single leaf. Coil and leaf springs of the type to which the present invention relates are typically used in automobiles or other vehicles for shock resistance.

It is desirable for such springs to be composed of steel having a relatively high hardness (e.g. above Rockwell C ($R_c$) 52) because the corresponding relatively high tensile strength produces improved resistance to fatigue and to sag on the part of the spring. However, in the past, constraints have been imposed upon the maximum hardness of steels employed for springs because a hardness above $R_c$ 52 could result in premature failure due to poor fracture or notch toughness. Fracture toughness is usually expressed in $K_{Ic}$ units for a given hardness level. Fracture toughness usually decreases with an increase in hardness.

For example, there is a conventional, commercially available steel, identified as SAE 5160, which contains 0.56–0.64 wt. % carbon. A modification of SAE 5160, identified as SAE 9259, includes 0.75 wt. % silicon. When the SAE 9259 steel was heat treated to a hardness of $R_c$ 54, the fracture toughness was less than 27 MPa.m$^{\frac{1}{2}}$. The SAE 9259 steel could be treated to produce a fracture toughness greater than 27 MPa.m$^{\frac{1}{2}}$, but this toughness could be obtained only by heat treating to a hardness less than $R_c$ 52. More particularly, the SAE 9259 had a fracture toughness of 36.5 MPa.m$^{\frac{1}{2}}$ for a hardness of $R_c$ 48 and 33.0 MPa/m$^{\frac{1}{2}}$ for a hardness of $R_c$ 51; but the SAE 9259 steel heat treated to a hardness of $R_c$ 54 had a fracture toughness of only 26.7 MPa.m$^{\frac{1}{2}}$.

It would be desirable to produce a spring composed of steel having a hardness of at least $R_c$ 52 together with a fracture toughness substantially greater than 27 MPa.m$^{\frac{1}{2}}$.

SUMMARY OF THE INVENTION

The present invention employs a combination of steel composition, hot roll finishing and cooling conditions and heat treating procedures to enable the formation of a coil or leaf spring composed of a steel having a hardness of an least $R_c$ 52 together with a fracture toughness substantially greater than 27 MPa.m$^{\frac{1}{2}}$. The spring is composed of a steel having a hardness in the range $R_c$ 52–55 for example, and a toughness in the range 36.0–38.5 MPa.m$^{\frac{1}{2}}$, for example. The improved toughness of the steel is due to its lower carbon content (e.g. 0.40–0.50 wt. %) compared to SAE 5160 or SAE 9259 (0.56–0.64 wt. % carbon). Improved toughness is also attributable to a relatively fine austenitic grain size (e.g. finer than ASTM 10) which in turn is attributable to the employment of a grain growth inhibitor such as columbium, among other things.

Although the carbon content is relatively reduced compared to SAE 5160 steel, the hardness and strength are comparable to SAE 5160, due to the employment of certain alloying ingredients, such as vanadium, in relatively small amounts, and to the heat treating procedures which produce, at room temperature, a microstructure consisting essentially of (i) a matrix of tempered martensite and (ii) within that matrix, particles of $Fe_3C$, particles of carbonitrides of vanadium and columbium and particles of titanium nitride (when titanium is employed, as an option). The particles of columbium carbonitride (and the particles of titanium nitride, if Ti is employed) act to control the prior austenitic grain size during hot rolling of the bar and to control the austenitic grain size during heat treatment of the bar. The particles of vanadium carbonitride are finely dispersed throughout the matrix and act as a dispersion strengthening agent.

The hot rolling, manufacturing and heat treating procedure for producing a steel spring having the properties described above includes a number of steps. A steel bar rolled in accordance with predetermined hot roll finishing and cooling conditions and having the desired steel composition is heated to an austenitizing temperature, for a time constrained to produce a steel microstructure consisting essentially of austenite having a grain size finer than ASTM 10. The rolled steel bar is then formed into the shape of a coil spring or leaf spring leaf while the steel bar is at the austenitizing temperature and has the microstructure described in the preceding sentence. The spring shape is then quenched, from the austenitizing temperature, at a cooling rate sufficient to provide a microstructure consisting essentially of untempered martensite, at ambient temperature. The quenched spring shape is then tempered (heated) under time and temperature conditions which provide the tempered, martensitic microstructure described in the preceding paragraph. The shape is then set and shot peened, employing conventional setting and shot peening procedures, to produce the final coil spring or leaf spring leaf which is then coated for corrosion resistance. Several leaf spring leafs may be assembled together to produce a multi-layered leaf spring.

Other features and advantages are inherent in the product and method claimed and disclosed or will become apparent to those skilled in the art from the following detailed description.

DETAILED DESCRIPTION

In accordance with one embodiment of the present invention, a steel bar is rolled from a steel composition having the following permissible ranges of ingredients, in weight percent.

| Element | Range |
|---|---|
| Carbon | 0.40–0.50 |
| Manganese | 1.10–1.40 |
| Phosphorous | 0.025 max. |
| Sulfur | 0.015 max. |
| Silicon | 1.15–1.50 |
| Chromium | 0.45–0.75 |
| Aluminum | 0.04 max. |
| Vanadium | 0.12–0.17 |
| Columbium | 0.015–0.030 |
| Nitrogen | 0.010 min. |
| Iron | essentially the balance. |

The steel may also include 0.005–0.020 wt. % titanium.

The hot rolling procedure for producing the steel bar includes a hot roll finishing step performed at an austenitic finishing temperature below 1650° F. (899° C.). The lower the finishing temperature, the better, consistent with temperature constraints imposed by mechanical deformation requirements. The hot rolled bar is then cooled, initially rapidly to substantially avoid coarsening of the fine austenire grains prevailing at the completion of hot rolling, typically ASTM 9 or finer. The fine austenitic grain size in the hot rolled bar before cooling (prior austenitic grain size) is due to the presence of columbium carbonitride particles which are located at the austenire grain boundaries (and within the austenire grains) and to titanium nitride particles at the grain boundaries (when titanium is employed). The grain boundary particles inhibit austenire grain growth, and to the extent that there are moving austenite grain boundaries, these become hung up on columbium carbonitride particles within the austenite grains.

After the initial rapid cooling rate conducted to avoid austenitic grain growth, cooling is conducted more moderately through the time, temperature, transformation zone for that steel to produce a microstructure at ambient temperature consisting essentially of ferrite, pearlite and bainire and having a hardness of less than 32 Rockwell C.

In summary, the hot rolled bar, prior to heat treating, has a microstructure consisting essentially of ferrite, pearlite and bainite, a prior austenitic grain size at least as fine as ASTM 9 and a hardness less than 32 $R_c$.

The hot rolled steel bar has the capability of attaining (a) the tempered, martensitic microstructure and (b) the physical characteristics described below, when the hot rolled steel bar is austenitized, quenched and tempered in the manner described below.

The tempered martensitic microstructure consists essentially of (i) a matrix of tempered martensite and ii) within the matrix, particles of $Fe_3C$, particles of vanadium and columbium carbonitride (and particles of titanium nitrides, when Ti is used). Another microstructural characteristic is an austenitic grain size at least as fine as ASTM 10.

The physical characteristics of a steel bar having the microstructure described in the preceding paragraph comprise (i) a Rockwell C ($R_c$) hardness no less than 52, (ii) a yield strength of at least 250 ksi (1,724 MPa), (iii) a tensile strength of at least 270 ksi (1,861 MPa), (iv) a total elongation of at least 7% and (v) a fracture toughness substantially greater than 27 MPa.m$^{\frac{1}{2}}$.

The hot rolled steel bar having the composition described above is formed into a coil spring or leaf spring leaf having the microstructure and physical characteristics described above, utilizing the following procedure. Initially, the surface of the rolled steel bar is machined or peeled to remove the surface-adjacent layer. Then the rolled steel bar is heated to an austenitizing temperature, e.g. 1650°-1750° F. (899°-954° C.) to produce a microstructure consisting essentially of fine grained austenite (at least as fine as ASTM 10). The rolled steel bar is then formed into the shape of a coil spring or leaf spring leaf while the steel bar is at the austenitizing temperature and has the steel microstructure which are described in the preceding sentence. It usually takes only a few seconds to form the spring shape; therefore, there is little time for any significant austenitic grain growth to occur during the coil or leaf forming operation. The formed coil or leaf shape is then quenched, from the austenitizing temperature, at a cooling rate sufficient to provide a microstructure consisting essentially of untempered martensite at ambient temperature. When reference is made herein to a microstructure consisting essentially of martensite it means that the microstructure contains greater than 90% martensite, e.g. 95% martensite.

After quenching, the coil or leaf shape is tempered at a temperature of about 625°-675° F. (329°-357° C.) for about $\frac{3}{4}$-2 hours to provide a tempered, martensitic microstructure consisting essentially of (i) a matrix of tempered martensite and (ii) dispersed within the matrix, particles of $Fe_3C$, particles of vanadium and columbium carbonitrides (and particles of titanium nitride, when Ti is used); the microstructure reflects an austenitic grain size at least as fine as ASTM 10. The coil or leaf shape is then set and shot peened, to produce a final coil spring or leaf spring leaf. The setting procedure is a conventional procedure in which the spring is compressed at ambient temperature or at a warmer temperature, e.g. about 300° F. (149° C.), for a time of about less than one minute, to obtain the set spring. A plurality of leaf spring leafs may then be assembled together to form a multi-layered leaf spring.

Shot peening is a conventional manufacturing procedure, and in this case it is performed (a) on the coil spring embodiment of the present invention typically after quenching and tempering and prior to setting, and (b) on the leaf spring embodiment typically during setting while the leaf spring is in a set, deflected, prestressed position.

Shot peening imparts to the spring a residual compressive stress on at least the surface-adjacent portions of the spring, and that residual compressive stress improves (a) the fatigue resistance of the spring and (b) the spring's resistance to stress corrosion cracking.

A final procedure in the spring-manufacturing operation comprises coating the spring, after shot peening, to improve the corrosion resistance of the spring which in turn contributes to the spring's improved resistance to stress corrosion cracking. In one example of a coating procedure, the spring is initially coated with a zinc phosphate primer and then coated, in an electrostatic painting operation, with a paint of the type currently conventionally applied to automobile springs and other parts on the under-side of an automobile. Another example of a coating procedure comprises these three steps: (a) applying a zinc phosphate primer; (b) then applying a liquid epoxy coating; and (c) then applying a polyethylene top coating.

Referring again to the heat treating procedure for the steel bar, a preferred austenitizing temperature is 1700° F. (927° C.), for example. Heating to the austenitizing temperature is preferably performed in an electric induction furnace, and once the steel bar attains the desired austenitizing temperature, the time at that temperature is restricted to minimize austenitic grain growth, e.g. a time of less than one minute for bars undergoing induction heating. As previously noted, the austenitic grain size at the time quenching begins should be ASTM 10 or finer. In other types of reheating furnaces, the time constraints for obtaining and retaining the desired austenitic grain size may differ; these can be determined empirically.

The quenching medium may be a conventional, commercially available quenching oil or a polymer quenching medium, such as that identified as Aqua-Quench TM, produced by E.F. Houghton. As noted above, the quenching rate should be one sufficiently rapid to produce, at ambient temperature, a microstructure consisting essentially of untempered martensite. The minimum quenching rate necessary to produce the desired microstructure will depend upon the composition, particularly the carbon content of the steel; the required quenching rate can be determined empirically by one skilled in the art of heat treating and quenching steel. For example, a composition in accordance with the present invention and having the composition of Example B (described below) which has a carbon content of 0.49 wt. %, requires a quenching rate, determined at 704° C. (1300° F.), of about 125° C./sec (225° F./sec).

Preferred tempering conditions comprise a temperature of 650° F. (343° C.) for up to 2 hours, for example. Care should be exercised to avoid tempering at too high a temperature or for too long a period of time, to avoid producing a final product which has a hardness lower than that desired (i.e. no lower than $R_c$ 52).

Referring again to the steel composition of the present invention, it is preferred that carbon be in the range of 0.43–0.50 wt. % and that manganese be in the range of 1.10–1.35 wt. %. A higher manganese content (e.g. up to 1.45 wt. %) might be tolerated, but the higher the manganese content, the greater the risk of increased retention of austenite following quenching.

Phosphorous and sulfur are impurity elements, and thus their presence should be minimized. Preferred phosphorous and sulfur contents are 0.015 wt. % max. phosphorous and 0.012 wt. % max. sulfur.

The aluminum in the composition arises from the use of aluminum as a deoxidizer which is important in that it enables the production of a cleaner steel which in turn improves the fatigue life of the coil spring produced from the steel.

The maximum nitrogen content is controlled by the solubility of nitrogen in molten steel, and one would not expect a nitrogen content greater than 0.022 wt. %

Columbium forms carbonitride particles which are located at the grain boundaries of prior austenire grains and are also dispersed throughout the matrix of the steel. These particles inhibit austenitic grain growth at the prior austenitic grain boundaries and form localized spots at which moving austenitic grain boundaries get hung up.

Vanadium forms fine vanadium carbonitride particles which are widely dispersed throughout the matrix of the steel and act as a dispersion strengthening agent. The spacing between vanadium carbonitride particles should be less than 100 angstroms ($100\times10^{-10}$ meters) for effective strengthening and for inhibition of microyielding under cyclic (fatigue) loading conditions of the spring. If the spacing is too great, additional vanadium (within the limits of 0.12–0.17 wt. %) should be used. Vanadium carbonitride particles also perform an austenire grain refining function but to a much lesser extent than columbium carbonitride particles.

As noted above, the columbium carbonitride particles and the titanium nitride particles act to refine the prior austenitic grain size in the hot rolled bar. The hot roll finishing conditions and the cooling conditions for the hot rolled bar, described above, in conjunction with the columbium carbonitride particles and the titanium nitride particles establish a very fine, prior austenitic grain size (at least ASTM 9) and a correspondingly fine grained microstructure at room temperature.

There is very little redistribution of the columbium carbonitride and titanium nitride particles from the distribution which existed when these particles exercised a refining effect on the prior austenire grains. The refining effect of these particles on austenitic grain size, particularly on the part of the columbium carbonitride particles, is carried over during the austenitizing operation. As noted above, the prior austenitic grain size was at least ASTM 9. The employment of a rapid austenitization procedure (e.g. by induction heating) will result in a still finer subsequent austenitic grain size range, e.g. at least as fine as ASTM 10.

Typical physical characteristics for a coil spring or leaf spring leaf produced in accordance with the present invention comprise a Rockwell C hardness ($R_c$) between 52 and 55 and a fracture toughness in the range 36.0–38.5 MPa.m$^{\frac{1}{2}}$.

Typical examples of steel compositions employed in accordance with the present invention to produce a spring in accordance with the present invention (e.g. a coil spring) are set forth below, as Examples A, B and C. The amounts tabulated below are in weight percent.

| Element | A | B | C |
|---|---|---|---|
| C | 0.41 | 0.49 | 0.49 |
| Mn | 1.38 | 1.15 | 1.24 |
| P | 0.014 | 0.012 | 0.013 |
| S | 0.012 | 0.015 | 0.007 |
| Si | 1.26 | 1.27 | 1.29 |
| Al | — | — | 0.036 |
| Cr | 0.72 | 0.53 | 0.54 |
| V | 0.16 | 0.15 | 0.14 |
| Cb | 0.023 | 0.024 | 0.023 |
| N | 0.021 | 0.013 | 0.015 |

Iron is essentially the balance for all three examples A–C. One may employ 0.005–0.020 wt. % titanium as an optional ingredient in all three examples. Although no aluminum content for examples A and B are given, an aluminum content up to 0.04 wt. % may be advantageously employed.

The foregoing detailed description has been given for clearness of understanding only and no unnecessary limitations should be understood therefrom, as modifications will be obvious to those skilled in the art.

We claim:

1. A spring made from a rolled steel bar and having the steel composition, the microstructure and the physical characteristics recited below:

said steel composition consisting essentially of, in wt. %:

| | |
|---|---|
| carbon | 0.40–0.50 |
| manganese | 1.10–1.40 |
| phosphorous | 0.025 max. |
| sulfur | 0.015 max. |
| silicon | 1.15–1.50 |
| chromium | 0.45–0.75 |
| aluminum | 0.04 max. |
| vanadium | 0.12–0.17 |
| columbium | 0.015–0.030 |
| nitrogen | 0.010–0.022 |
| iron | essentially the balance |

said microstructure comprising a microstructure consisting essentially of (i) a matrix of tempered martensite and (ii) particles of $Fe_3C$ and of vandadium and columbian carbonitrides within said matrix;

said physical characteristics comprising a Rockwell C hardness no less than 52, and a fracture toughness substantially greater than 27 MPa.m$^{\frac{1}{2}}$.

2. A spring as recited in claim 1 wherein:
said tempered martensitic microstructure reflects an austenitic grain size at least as fine as ASTM 10.

3. A spring as recited in claim 1 or 2 wherein:
said particles of vanadium carbonitride are dispersed throughout said matrix and have a spacing no greater than 100 angstroms ($100\times10^{-10}$ meters).

4. A spring as recited in claim 1 or 2 wherein:
said physical characteristics comprise a fracture toughness in the range 36.0–38.5 MPa.m$^{\frac{1}{2}}$.

5. A spring as recited in claim 1 or 2 wherein said composition also includes 0.005–0.020 wt. % titanium.

6. A spring as recited in claim 1 or 2 wherein said composition comprises, in wt. %:
carbons: 0.43–0.50
manganese: 1.10–1.35.

7. A spring as recited in claim 1 or 2 wherein said composition comprises 0.015 wt. % max. phosphorous.

8. A spring as recited in claim 1 or 2 wherein said composition comprises 0.012 wt. % max. sulfur.

9. A spring as recited in claim 1 or 2 wherein said composition comprises, in wt. %:
carbon: 0.43–0.50
manganese: 10–1.35
phosphorous: 0.015 max.
sulfur: 0.012 max.

10. A spring as recited in claim 9 wherein:
said particles of vanadium carbonitride are dispersed throughout said matrix and have a spacing no greater than 100 angstroms ($100\times10^{-10}$ meters);
and said physical characteristics comprise a fracture toughness in the range 36.0–38.5 MPa.m$^{\frac{1}{2}}$.

11. A method for producing a spring from a rolled steel bar, said method comprising the steps of:
employing a hot rolled steel bar having a steel composition consisting essentially of, in wt. %:
carbon: 0.40–0.50
manganese: 1.10–1.40
phosphorous: 0.025 max.
sulfur: 0.015 max.
silicon: 1.15–1.50
chromium: 0.45–0.75
aluminum: 0.04 max.
vanadium: 0.12–0.17
columbium: 0.015–0.030
nitrogen: 0.010–0.022.
iron: essentially the balance
heating said rolled steel bar to an austenitizing temperature, for a time sufficient to produce a steel microstructure consisting essentially of fine grained austenire;
forming said rolled steel bar into the shape of a spring, while said steel bar is at said austenitizing temperature and has said steel microstructure;
quenching said spring shape, from said austenitizing temperature, at a cooling rate sufficient to provide a microstructure consisting essentially of untempered martensite, at ambient temperature;
tempering said quenched spring shape at a temperature of about 625°–675° F. (329°–357° C.) for about ¾–2 hours to provide a tempered, martensitic microstructure consisting essentially of (i) a matrix consisting essentially of tempered martensite and (ii) particles of $Fe_3C$ and of vanadium and columbium carbonitrides dispersed within said matrix;
and then setting said spring shape to produce the final spring.

12. A method as recited in claim 11 wherein:
said fine grained austenire has an austenitic grain size at least as fine as ASTM 10.

13. A method as recited in claim 11 or 12 wherein:
said particles of vanadium carbonitride are dispersed throughout said matrix and have a spacing no greater than 100 angstroms ($100\times10^{-10}$ meters).

14. A method as recited in claim 11 or 12 wherein said method produces a steel coil spring having the following physical properties:
a Rockwell C hardness no less than 52 and a fracture toughness substantially greater than 27 MPa/m$^{\frac{1}{2}}$.

15. A method as recited in claim 14 wherein:
said particles of vanadium carbonitride are dispersed throughout said matrix and have a spacing no greater than 100 angstroms ($100\times10^{-10}$ meters);
and said physical characteristics comprise a fracture toughness in the range 36.0–38.5 MPa/m$^{\frac{1}{2}}$.

16. A method as recited in claim 11 or 12 wherein said composition also includes 0.005–0.020 wt. % titanium.

17. A method as recited in claim 11 or 12 wherein said composition comprises, in wt. %:
carbon: 0.43–0.50
manganese: 1.10–1.35.

18. A method as recited in claim 11 or 12 wherein said composition comprises 0.015 wt. % max. phosphorous.

19. A method as recited in claim 11 or 12 wherein said composition comprises 0.012 wt. % max. sulfur.

20. A method as recited in claim 11 or 12 wherein said composition comprises, in wt. %:
carbon: 0.43–0.50
manganese: 1.10–1.35
phosphorous: 0.015 max.
sulfur; 0.012 max.

21. A method as recited in claim 11 wherein:
said austenitizing temperature is in the range 1650°–1750° F. (899°–954° C.).

22. A method as recited in claim 11 or 21 wherein said cooling rate is sufficient to produce a microstructure containing greater than 90% martensite.

23. A method as recited in claim 11 wherein said hot rolled steel bar is produced by a hot rolling procedure comprising:
finishing hot rolling at an austenitic finishing temperature less than 1650° F. (899° C.) and so as to provide a fine austenitic grain size at said finishing temperature at least as fine as ASTM 9;
cooling the resulting hot rolled steel bar from said finishing temperature, initially at a rate which substantially avoids coarsening of said fine austenitic grain size, and then at a rate through the time, temperature, transformation zone which provides a microstructure, at room temperature, consisting essentially of ferrite, pearlite and bainite and a hardness less than 32 Rockwell C.

24. A method as recited in claim 11 and comprising:
shot peening said quenched, spring shape after said tempering step;
and coating said final spring to improve its corrosion resistance.

25. A steel spring having a hardness no less than 52 Rockwell C and a fracture toughness substantially greater than 27 MPa/m$^{\frac{1}{2}}$.

26. A steel spring as recited in claim 25 wherein said fracture toughness is in the range 36.0–38.5 MPa/m$^{\frac{1}{2}}$.

27. A steel spring as recited in claim 25 or 26 wherein said spring has a yield strength of at least 250 ksi (1,724 MPa), a tensile strength of at least 270 ksi (1,861 MPa) and a total elongation of at least 7%.

* * * * *

UNITED STATES PATENT AND TRADEMARK OFFICE

CERTIFICATE OF CORRECTION

PATENT NO. : 5,368,656

DATED : November 29, 1994

INVENTOR(S) : William E. Heitmann, Prabhat K. Rastogi and Thomas G. Oakwood

It is certified that error appears in the above-identified patent and that said Letters Patent is hereby corrected as shown below:

Col. 1, line 39, "MPa/m$^{1/2}$" should be --MPa•m$^{1/2}$--.

Col. 1, line 40, "MPa/m$^{1/2}$" should be --MPa•m$^{1/2}$--.

Col. 1, line 43, "MPa/m$^{1/2}$" should be --MPa•m$^{1/2}$--.

Col. 1, line 44, "MPa/m$^{1/2}$" should be --MPa•m$^{1/2}$--.

Col. 1, line 46, "MPa/m$^{1/2}$" should be --MPa•m$^{1/2}$--.

Col. 1, line 50, "MPa/m$^{1/2}$" should be --MPa•m$^{1/2}$--.

Col. 1, line 58, "MPa/m$^{1/2}$" should be --MPa•m$^{1/2}$--.

Col. 1, line 61, "MPa/m$^{1/2}$" should be --MPa•m$^{1/2}$--.

Col. 3, line 8, "austenire" should be --austenite--.

Col. 3, line 13, "austenire" should be --austenite--.

UNITED STATES PATENT AND TRADEMARK OFFICE

CERTIFICATE OF CORRECTION

PATENT NO. : 5,368,656

DATED : November 29, 1994

INVENTOR(S) : William E. Heitmann, Prabhat K. Rastogi and Thomas G. Oakwood

It is certified that error appears in the above-identified patent and that said Letters Patent is hereby corrected as shown below:

Col. 3, line 16, "austenire" should be --austenite--.

Col. 3, line 25, "bainire" should be --bainite--.

Col. 3, line 37, after "and", "ii) should be --(ii).

Col. 3, line 49, "MPa/m$^{1/2}$" should be --MPa•m$^{1/2}$--.

Col. 5, line 40, "austenire" should be --austenite--.

Col. 5, line 55, "austenire" should be --austenite--.

Col. 6, line 2, "austenire" should be --austenite--.

Col. 6, line 15, "MPa/m$^{1/2}$" should be --MPa•m$^{1/2}$--.

Col. 6, line 67, "vandadium" should be -- vandium --.

Col. 7, line 3, "MPa.m$^{1/2}$" should be --MPa•m$^{1/2}$--.

UNITED STATES PATENT AND TRADEMARK OFFICE

CERTIFICATE OF CORRECTION

PATENT NO. : 5,368,656

DATED : November 29, 1994

INVENTOR(S) : William E. Heitmann, Prabhat K. Rastogi and Thomas G. Oakwood

It is certified that error appears in the above-identified patent and that said Letters Patent is hereby corrected as shown below:

Col. 7, line 18, "carbons" should be --carbon--.

Col. 7, line 27, "manganese: 10-1.35" should be --manganese: 1.10-1.35--.

Col. 7, line 35, "MPa.M$^{1/2}$" should be --MPa•M$^{1/2}$--.

Col. 7, line 52, "austenire" should be --austenite--.

Col. 8, line 2, "austenire" should be --austenite --.

Col. 8, line 12, "MPa/m$^{1/2}$" should be --MPa•m$^{1/2}$--.

Col. 8, line 18, "MPa/m$^{1/2}$" should be --MPa•m$^{1/2}$--.

Col. 8, line 61, "MPa/m$^{1/2}$"" should be --MPa•m$^{1/2}$--.

Col. 8, line 63, "MPa/m$^{1/2}$" should be --MPa•m$^{1/2}$--.

Signed and Sealed this

First Day of October, 1996

Bruce Lehman

*Attest:*

BRUCE LEHMAN

*Attesting Officer*

*Commissioner of Patents and Trademarks*